US010358392B1

(12) United States Patent
Guirguis

(10) Patent No.: US 10,358,392 B1
(45) Date of Patent: Jul. 23, 2019

(54) PROCESS FOR MAKING A POWDERED AMORPHOUS EXPLOSIVE

(71) Applicant: Department of the Navy, Indian Head, MD (US)

(72) Inventor: Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 230 days.

(21) Appl. No.: 15/731,875

(22) Filed: Aug. 18, 2017

(51) Int. Cl.

| | |
|---|---|
| ***D03D 43/00*** | (2006.01) |
| ***C06B 25/34*** | (2006.01) |
| ***C06B 21/00*** | (2006.01) |
| *D03D 23/00* | (2006.01) |
| *C06B 45/00* | (2006.01) |

(52) U.S. Cl.
CPC ..... *C06B 21/0066* (2013.01); *C06B 25/34* (2013.01)

(58) Field of Classification Search
USPC ..... 149/2, 92, 109.6
See application file for complete search history.

(56) References Cited

U.S. PATENT DOCUMENTS 4,137,849 A * 2/1979 Hontgas ..... C08K 5/45 102/481
4,764,329 A * 8/1988 Lerman ..... B01J 2/04 264/12
5,625,165 A * 4/1997 Wight ..... C06B 21/0083 149/109.6
6,136,115 A 10/2000 Highsmith et al.
6,226,887 B1 5/2001 Tenedini et al.
6,749,681 B1 * 6/2004 Burdis ..... C04B 7/36 106/739
2012/0111460 A1 * 5/2012 Martin ..... C06B 25/34 149/92

OTHER PUBLICATIONS

Figure 3 Source Title of paper: Vapor Pressures and Heats of Sublimation of Some High Melting Organic Explosives Author(s): Jerome M. Rosen and Charles Dickinson Publication: Journal of Chemical and Engineering Data, vol. 14, No. 1, pp. 120-124 (1969).
Figure 3 Source Title of paper: Vapor pressure and enthalpy of sublimation of 1,3,5,7-tetranitro-1,3,5,7-tetra-azacyclo-octane (HMX) Author(s): John Watson Taylor and Roy J. Crookes Publication: J. Chem. Soc., Faraday Trans. 1, 72, pp. 723-729 (1976).

* cited by examiner

*Primary Examiner* — James E McDonough
(74) *Attorney, Agent, or Firm* — Fredric J. Zimmerman

(57) ABSTRACT

A process for converting a crystalline energetic material to an amorphous energetic material that is less susceptible to accidental detonation initiation by mechanical insults. The process includes forming the amorphous energetic material as a deposition of a vapor of the crystalline energetic material sublimed from a hot surface in a vacuum. The deposition is onto a cryogenically cold surface of a dry ice layer. The deposition solidifies as a layer of amorphous energetic material. Subliming the dry ice layer therein breaking the layer of amorphous energetic material into a powder of the amorphous energetic material; and collecting the powder.

21 Claims, 6 Drawing Sheets

Table 1

| Chamber Pressure | Minimum Allowed Temperature of Hot Surfaces | Maximum Allowed Temperature of Cold Surfaces |
|---|---|---|
| $10^{-3}$ torr | 200 °C | -180 °C |
| $10^{-5}$ torr | 157 °C | -210 °C |
| $10^{-7}$ torr | 121 °C | -235 °C |

*FIG. 6*

PROCESS FOR MAKING A POWDERED AMORPHOUS EXPLOSIVE

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to a process for making a normally crystalline material into a material having an amorphous phase, and more particularly, an amorphous energetic material, where the amorphous energetic material is less sensitive to accidental detonation initiation by mechanical stimuli than the crystalline phase, and may be softened by heating, so it can be processed similar to a thermoplastic. Typically, crystalline materials are too rigid to be processed like a thermoplastic except as a composite mixed with a rubbery binder.

2. Background

Sublimation is when a solid changes to a gas without first becoming a liquid. Water as ice at 0° C. has a vapor pressure of 4.56 torr (0.006 atm), and if the pressure is reduced below 4.56 torr, ice at 0° C. sublimates into water vapor. Dry ice, which is solid carbon dioxide ($CO_2$), has a vapor pressure of 760 torr (1 atm) at −78.5° C., and as such dry ice, under normal atmospheric pressure, sublimates into $CO_2$ gas when the temperature is above −78.5° C.

Most energetic materials have very low vapor pressures, and have to be heated to very high temperatures to sublimate at atmospheric pressure, but that is not possible because they decompose before reaching that temperature. However, if the pressure is reduced to very low values, such as $10^{-7}$ torr, they can be sublimated by heating them to moderate temperatures, well below their decomposition temperature. For example, at 10e-7 torr, cyclotrimethylenetrinitramine (RDX) sublimates when heated to above 48.0° C.; and cyclotetramethylenetetranitramine, beta polymorph (β-HMX) sublimates at temperatures above 121.9° C.

The above describes the transformation from the solid to the gas phase. But even within the solid phase domain, solids can exist in more than one morphology, all of them solid, but each exhibiting a different structure. If the structure is highly ordered, the solid is crystalline. But the same material may have several stable crystallographic configurations, called polymorphs, all of them crystalline, but exhibiting different crystal structures. On the other hand, if the structure lacks long-range order, it is called an amorphous solid.

Both crystalline and amorphous solid materials exhibit some rigidity at room temperature, but their behavior significantly differs when heated to high temperatures. Crystalline materials remain rigid until they melt, but when amorphous materials are heated they become softer before they melt. The temperature at which an amorphous material starts softening is called the glass transition temperature. The amorphous material is hard below the glass transition temperature and soft above it. The temperature at which the amorphous material melts, beyond which the material is a liquid, is above the glass transition temperature. Between the glass transition temperature and the melting point, the material is a soft solid.

A material may incorporate both amorphous and crystalline components. If it does, it will exhibit a behavior that is a mixture of the characteristics of both. For example, even though crystalline materials do not go through a glass transition, a composite explosive charge made of crystalline HMX powder combined with a rubbery polymer will go through a glass transition when the composite is cooled. The rubber matrix goes through the glass transition, not the crystalline HMX. However, glass transition is not exclusive to rubbery materials. It is a general property of amorphous materials. Window glass is an amorphous material. It is a hard solid at room temperature, but if heated beyond glass transition, it is softened, which allows the glass to be blown into the desired shape, for example, a bulb. On the other hand, rubber is soft at room temperature, but hardens when cooled below glass transition. So an amorphous explosive ingredient powder can be softened by heating it above its glass transition temperature and molded neat into an explosive charge, without the need to combine it with a binder.

Conventional technology discloses a process for making amorphous chlorine azide, an energetic material that is very sensitive in the crystalline phase. Vapors of chlorine azide are deposited at a slow rate in a vacuum chamber at 2 torr on a CsI window cooled to 77 K (−196° C.) by liquid nitrogen, forming an amorphous thin film of chlorine azide. Also taught are semi-crystalline films formed at 90 K to 100 K (−183° C. to −173° C.), and crystalline films formed at 120 K (−153° C.).

Initiating a detonation wave in the deposited films was done using a pulsed laser. One pulse was sufficient to initiate the crystalline film, but the amorphous film tolerated thousands of pulses before it was initiated. And when successfully initiated, the measured detonation velocity in the amorphous film was 640 m/s, which is much lower than 1330 m/s, the detonation velocity measured in the crystalline chlorine azide thin film. There appears to be a strong correlation between rate of deposition and crystallinity. The process does not include a method for separating the azide film from the CsI window in order to collect it in powder form.

SUMMARY OF THE INVENTION

A first object of the invention is to provide a process for converting an energetic material available in the crystalline phase to the energetic material in the amorphous phase. The inventive process provides for this conversion without having to melt the crystalline material first like the conventional technique of rapidly quenching the molten phase, which is sometimes employed to make amorphous materials, but requires melting the material first, so it cannot be used for making amorphous nitroamines, for example amorphous RDX or HMX. Nitroamines are the highest performing explosives known to date, but because nitroamines have melting points that are too close to the temperature at which they start decomposing, nitroamines cannot be safely converted to an amorphous phase by rapidly quenching the molten phase.

A second object of the invention is to provide a process for converting a crystalline energetic material to the amorphous phase, which in general is less sensitive to mechanical insults, like the impact of a high velocity fragment that often accidentally initiates crystalline explosives.

A third object of the invention is to provide a process for converting a crystalline energetic material to the amorphous phase, which can be softened by heating it beyond its glass transition temperature. It may be processed using conventional thermoplastic equipment, unlike the crystalline phase, which is too rigid at room temperature to process like a thermoplastic, and does not soften by heating, but suddenly melts when the melting temperature is reached.

A fourth object of the invention is to provide the amorphous energetic material in powder form, which may be combined with a rubbery polymeric binder to make an explosive charge. However, and unlike the crystalline version, the energetic material also may be processed neat, without a binder, thus achieving an explosive charge with 100% loading, by heating the amorphous powder until it is softened and then molding it (pushing it or injecting it under pressure in a mold), like a thermoplastic, and letting it cool into a solid explosive charge.

A fifth object of the invention is that the process is suitable for both small-scale lab trials and large-scale production.

BRIEF DESCRIPTION OF THE DRAWINGS

The foregoing invention will become readily apparent by referring to the following detailed description and the appended drawings in which:

FIG. 6 contains TABLE 1, which provides three typical vacuum chamber pressures, which are generally low, and the related minimum allowed piccolo tube heater temperature for sublimating the crystalline energetic material and the maximum allowed cold walls temperature to prevent the dry ice formed on these walls from sublimating at low pressures.

DETAILED DESCRIPTION OF THE INVENTION

A process for converting a crystalline energetic material to an amorphous energetic material that is less susceptible to accidental detonation initiation by mechanical insults.

Figure 5:
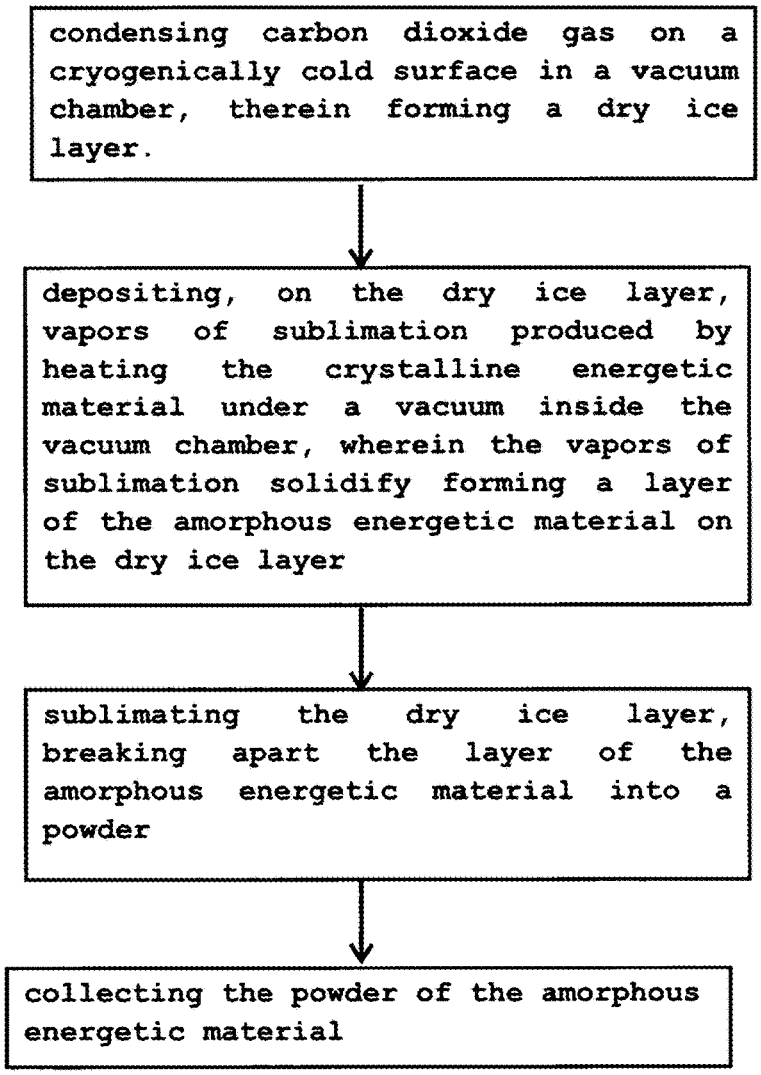
FIG. 5 is a process flow diagram for the invention.

The process, as shown in FIG. 5, includes condensing carbon dioxide gas on a cryogenically cold surface in a vacuum chamber, therein forming a dry ice layer; depositing, on the dry ice layer, vapors of sublimation produced by heating the crystalline energetic material under a vacuum inside the vacuum chamber. The vapors of sublimation solidify forming a layer of the amorphous energetic material on the dry ice layer; sublimating the dry ice layer, breaking apart the layer of the amorphous energetic material into a powder; and collecting the powder of the amorphous energetic material.

The process is capable of transforming any crystalline energetic material into the amorphous phase. It is especially useful for energetic materials that fall into a class of materials that are nitroamines.

Examples of energetic materials belonging to the nitroamines group include: HMX (Octahydro-1,3,5,7-tetranitro-1,3,5,7 tetrazocine), RDX (1,3,5-Trinitro-perhydro-1,3,5-triazine), Nitroguanidine (1-Nitroguanidine), and CL-20 (Hexanitrohexaazaisowurtzitane).

The resulting amorphous energetic material that is formed is as energetically potent as the crystalline energetic material.

Furthermore, using HMX as a representative of nitroamines, the amorphous HMX may be softened when heated above 180° C.±about 10° C. This softening allows the powder of the amorphous HMX to be molded neat without a binder, using the same techniques that are employed to process thermoplastics into shapes, or alternatively, to be processed without softening amorphous HMX first by combining it with a rubbery binder.

Amorphous HMX that has been softened by heating may be molded into a consolidated explosive charge, which remains amorphous throughout the heating and molding process, and upon cooling to room temperature, with little shrinkage or cracking upon solidification. The molded amorphous HMX will yield a 100% solid-loaded explosive charge that is much less sensitive than explosive charges produced by pressing a crystalline HMX powder.

Figure 1:
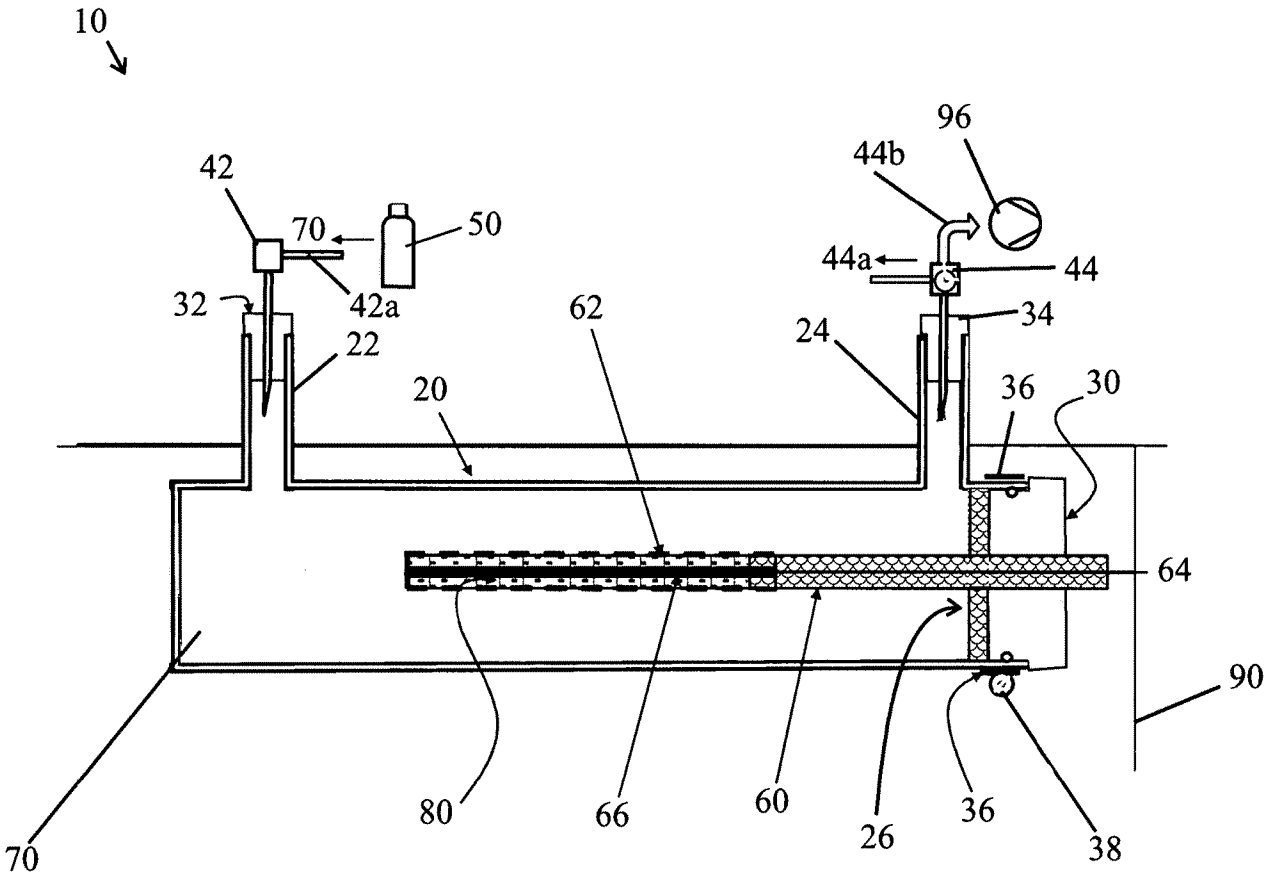
FIG. 1 is a diagrammatic view of a lab-scale processing system for making a powdered amorphous energetic material, wherein the processing system includes a vacuum chamber including thermally conductive walls that can be submerged in a cryogenic bath of liquid nitrogen or some similar cryogenic fluid.

The process for converting a crystalline energetic material to an amorphous energetic material includes the following steps and structure. Referring to FIG. 1, a vacuum chamber 10 includes thermally conductive walls 20, an inlet 22 for carbon dioxide, an outlet 24 for venting circulated carbon dioxide and evacuating the vacuum chamber 10, an access port 26, which includes a sealing plug 30 that supports a ceramic holder 60 with a piccolo tube 62, which includes a plurality of perforations, and a heating means 66 for heating energetic material 80 loaded in the piccolo tube 62. In particular, the chamber 10 includes an enclosing wall 20 that is thermally conductive and mechanically sufficient to withstand evacuation to low pressures, at least as low as about 10e-3 torr, and cooling to temperatures at least as low as about −196° C., the temperature of liquid nitrogen at atmospheric pressure. In the exemplary embodiment illustrated in FIG. 1, the chamber 10 has an inlet 22 with an inlet valve 42 having an open inlet position 42*a* and a closed inlet position, where in the open inlet position carbon dioxide gas 70 can flow into the chamber 10 and in the closed inlet position flow is occluded. There is at least one outlet 24 with an outlet valve with an open outlet position and a closed outlet position. In the open outlet position, gas may flow out of the chamber 10, and in the closed outlet position flow is occluded. The structure includes a vacuum outlet with a vacuum valve with an open valve position and a closed valve position. In the open valve position, gas is evacuated from the chamber and in the closed valve position flow into or out of the chamber is occluded.

In FIG. 1 the outlet valve and the vacuum valve are combined into a three way valve 44, wherein the three positions are the open outlet position 44*a*, the open vacuum valve position 44*b* and the closed position.

There is a holder 60 mounted on a sealing plug 30 for the access port 26, where the holder 60 includes a piccolo tube 62 in which the crystalline energetic material 80 is loaded, and equipped with a heating means 66. In an exemplary embodiment, the heating means 66, for example is a heating ribbon. The piccolo tube wall has a plurality of perforations through which the vapors of the heated energetic material can escape into the vacuum chamber.

Although not shown in FIG. 1, a pressure sensor mounted inside the vacuum chamber monitors the pressure, and generally there is a manometer in communication with the line 44*b* to the vacuum pump 96. The heating strip 66 is generally powered by an electrical source 64. A hose clamp 36 tightened with a screw 38 reversibly seals the sealing plug 30 in the access port 26. An inlet stopper 32 and an outlet stopper 34 seal the inlet 22 and outlet 24, respectively.

The process includes providing a source (i.e. tank 50) of carbon dioxide 70 through the inlet 22 after the inlet valve 42 is opened.

The step-by-step process starts with loading the piccolo tube 62 with the crystalline energetic material 80 and positioning the holder 60 and the piccolo tube 62 in the vacuum chamber 10. The process further includes closing the access port 26 with the sealing plug 30, which is held in place with the hose clamp band 36 having the screw 38 tightened.

Purging of the air initially inside the vacuum chamber 10 while the vacuum chamber is at about atmospheric pressure by circulating the carbon dioxide gas 70 for about 1 to about 5 minutes. The carbon dioxide gas 70 flows through the inlet 22 and out the outlet 24 with the three-way valve positioned to an open outlet position 44*a*, leaving the vacuum chamber 10 filled with carbon dioxide gas.

Forming a layer of dry ice 74 on an inward side 21 of the enclosing wall 20, is also done at atmospheric pressure, while still circulating the carbon dioxide gas through inlet 22 and out the outlet 24, by submerging the vacuum chamber 10 in a bath of liquid nitrogen 90, which at atmospheric pressure has a temperature of about −196° C. The inward side 21 of the enclosing wall 20 of the vacuum chamber 10 provides a very cold surface on which the carbon dioxide gas condenses as dry ice, a solid.

Continuing circulation until a sufficiently thick dry ice layer is formed, wherein circulating the carbon dioxide gas is ceased.

Evacuating the carbon dioxide gas remaining inside vacuum chamber 10 using the vacuum pump 96 with the three-way valve 44 set to an open vacuum position 44*b* and the two-way inlet valve 42 closed, until the pressure in the vacuum chamber 10 is reduced to about 10 e-3 torr, and then closing the three-way valve 44.

Using the heating means 66 to heat the crystalline energetic material 80 10° C. to 20° C. higher than 200° C., its sublimation temperature corresponding to the pressure of about 10 e-3 torr, where it sublimates therein producing vapors 82 of sublimation of the energetic material.

Depositing the vapors 82 of sublimation on the dry ice layer 74 forming a second layer composed largely of amorphous energetic material 84.

Adjusting the rate of heating wherein the rate of generating the vapors 82 of sublimation is about equal to the rate of depositing the vapors 82 of sublimation on the dry ice layer 74, therein maintaining a steady pressure inside the vacuum chamber at about 10 e-3 torr.

Turning off the heating means 66 after a layer of the amorphous energetic material 84 that is sufficiently thick has formed on the dry ice layer.

Allowing the deposition of the vapors 82 of sublimation on the dry ice layer to continue for a few minutes, therein providing time for the energetic material vapors remaining inside the chamber to be deposited.

Warming the vacuum chamber by removing it from the bath of liquid nitrogen 90 allowing the temperature inside the vacuum chamber to rise causing the dry ice layer to sublimate into carbon dioxide gas which increases the pressure inside the chamber.

Turning outlet valve 24 to the open outlet position 44*a* after the pressure inside the chamber builds up to atmospheric pressure to allow the carbon dioxide resulting from further sublimation of the dry ice layer to escape.

Subliming the dry ice layer into carbon dioxide gases also dislodges and breaks up the layer of the amorphous energetic material 84, thus separating the amorphous energetic material from the inward side of the enclosing wall 20 as powder 86.

Collecting the amorphous energetic powder 86 from the vacuum chamber 10 by removing the sealing plug 30 from the access port 26 enabling the powder 86 to be poured out.

Figure 2:
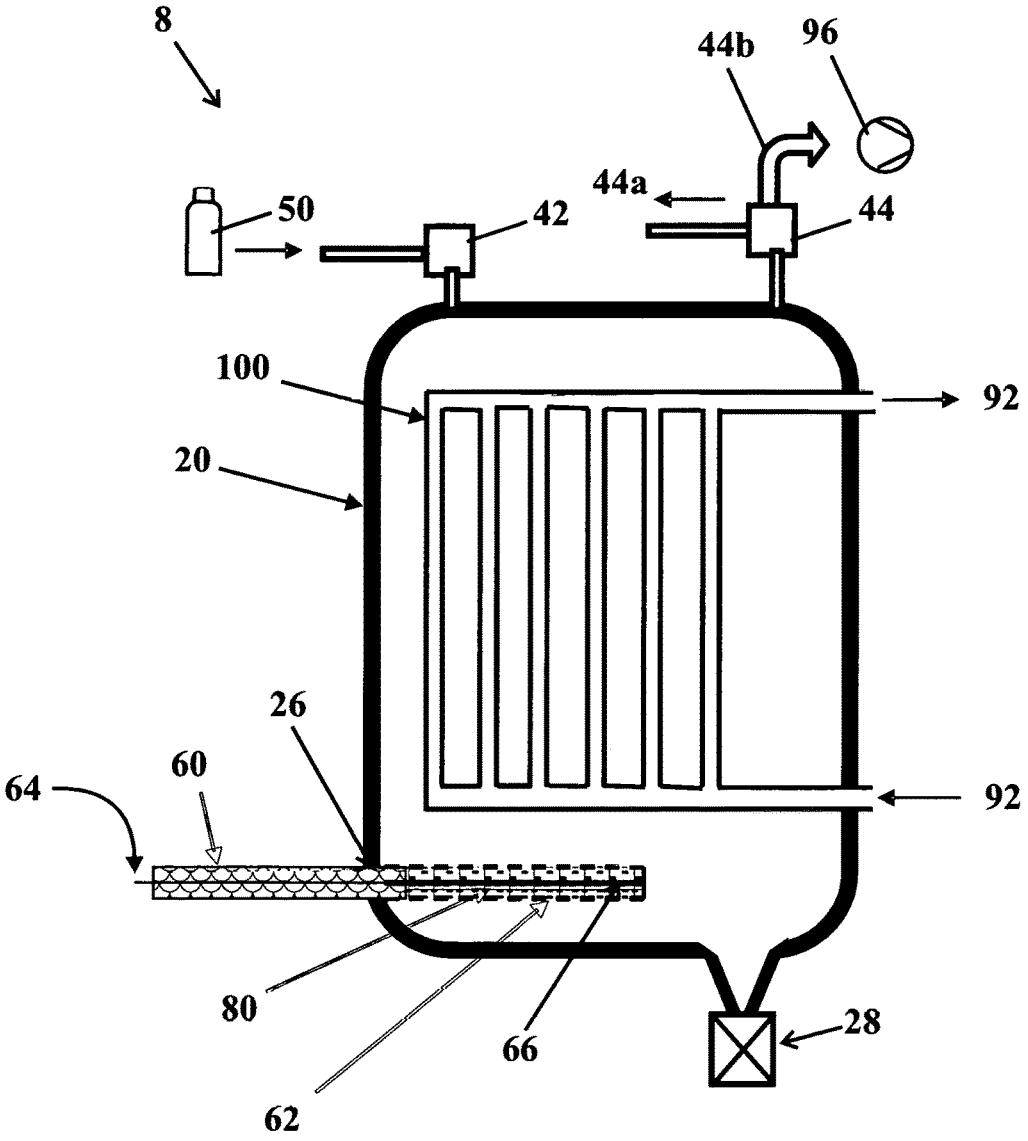
FIG. 2 is a diagrammatic view of a vacuum chamber suitable for large-scale production of a powdered amorphous energetic material, wherein the vacuum chamber contains a set of thermally conductive pipes through which cryogenically cold helium gas be circulated.

The vacuum chamber 8 shown in FIG. 2 has an enclosing wall 20 that is mechanically sufficient to withstand evacuation to very low pressures as low as 10e-7 torr, and mechanically sufficient to support a set of thermally conductive pipes 100 through which helium gas 92 at very low temperatures as low as −250° C. or lower is circulated, thus providing a very large cold surface area on which the energetic material vapor is deposited. The vacuum chamber includes the access port 26 in which is mounted a ceramic holder 60 holding a piccolo tube 62 in which the crystalline energetic material 80 is loaded, and equipped with heating means 66 and a plurality of perforations through which the vapors of the heated energetic material can escape into the vacuum chamber. The vacuum chamber includes a powder collection port 28, an inlet 22 with a two way valve 42 for carbon dioxide gas to enter and purge the chamber, and an outlet 24 with a three way valve 44 for venting the carbon dioxide or evacuating the chamber.

The set of thermally conductive pipes are cooled by internally circulating cold gaseous helium at a temperature of about −240° C. to −250° C., or a temperature 5° C. to 15° C. lower than −235° C., the sublimation temperature of dry ice at 10e-7 torr, which is significantly colder than liquid nitrogen at atmospheric pressure (−196° C.). At atmospheric pressure, helium becomes a liquid at 4 K (−269° C.), and potentially liquid helium could be used, but it is much more difficult to handle than gaseous helium. The lower end of the temperature range is warmer than 4 K (−269° C.), which is still significantly colder than liquid nitrogen. As a general rule, the colder the cryogenically cold surface is, the faster the dry ice layer forms, and the faster the layer of amorphous energetic can be formed.

In the previous embodiment, the chamber 10 could potentially be cooled using gaseous helium instead of submerging it in liquid nitrogen. The choice between liquid nitrogen or gaseous helium depends on the value of the vacuum pressure during vapor deposition. To keep the layer of dry ice already deposited on the inner walls from sublimating when the pressure is reduced, the temperature of the wall has to be colder than the dry ice sublimation temperature at that pressure. Liquid nitrogen at −196° C. is an adequate cooling medium for vacuum pressures at or above $10^{-4}$ torr. At pressures below $10^{-4}$ torr, cold helium gas at temperatures lower than −196° C. has to be circulated through the pipes.

The process using the vacuum chamber 8 in FIG. 2 utilizing cold helium includes the steps of:

Providing the vacuum chamber 8 with access port 26 and powder collection port 28, wherein the vacuum chamber's enclosing wall 20 is mechanically sufficient to withstand evacuation to a pressure as low as about 10e-7 torr and mechanically sufficient to support at least one set of thermally conductive pipes 100, providing a large cold surface on which the vapor of the energetic material is deposited. The pipes are cooled by circulating cold helium gas 92 through them. The cold helium gas 92 has a temperature of about −240° C. to −250° C. The vacuum chamber 8 has an inlet 22 with a two way valve 42, an outlet 24 with a three way valve 44, and a ceramic holder 60 mounted in the access port 26, and to which is attached a piccolo tube 62 having a plurality of perforations. The piccolo tube 62 has a heating means 66.

Providing a controlled flow of carbon dioxide into the vacuum chamber 8 through the inlet 22 when the two-way valve 42 is open, and no flow through the inlet when the two-way valve is closed.

Providing an evacuating means through the outlet 24 when the three-way valve 44*b* is selected to evacuation, a purging means through the outlet 24 when the three-way valve is selected to vent 44*a*, therein purging the vacuum chamber 8 of all gases except the purging gas, and when the three-way valve is closed, flow through the outlet 24 is occluded.

Loading the piccolo tube 62 with the crystalline energetic material 80 and positioning the holder 60 with the piccolo tube 62 in the vacuum chamber 8, therein sealing the access port 26.

Purging the air initially filling vacuum chamber 8 with carbon dioxide gas 70 by switching the two-way valve 42 to open and switching the three-way valve 44 to vent, wherein the vacuum chamber 8 is filled with the purge gas, carbon dioxide gas 70. The pressure inside the chamber remains at about normal atmospheric pressure.

Starting the circulation of cold helium gas 92 through the set of thermally conductive pipes 100, while carbon dioxide gas 70 is circulating through the vacuum chamber 8 coming in through open valve 42 and venting out through valve 44*a*. The pressure inside the vacuum chamber 8 remains at about normal atmospheric pressure.

Forming a dry ice layer on the set of thermally conductive pipes 100, wherein as carbon dioxide gas 70 comes into contact with the cryogenically cold outer surface of the pipes, it condenses forming the dry ice layer.

Evacuating the vacuum chamber 8 by closing the two-way valve 42 and opening the three-way valve 44 selected to evacuation 44*b*, whereupon most of the carbon dioxide remaining inside the chamber is removed. Evacuation continues until the pressure drops to about 10 e-7 torr, and then the three-way valve 44 closed.

Heating the crystalline energetic material with heating means 66 to a temperature that exceeds by 10° C. to 20° C. its sublimation temperature at pressure of 10 e-7 torr, which is equal to 121° C., wherein it sublimes producing a vapor of energetic material. The vapor of energetic material is deposited on the layer of dry ice forming a layer of energetic material solidified in its amorphous phase.

Adjusting the rate of heating such that the rate of generating the vapor of the energetic material is equal to the rate of depositing the vapor of the energetic material on the layer of dry ice, in order to keep a steady pressure inside the vacuum chamber 8 at about 10 e-7 torr.

Turning off the heating means 66 after a sufficiently thick layer of the amorphous energetic material is deposited on the dry ice layer, but allowing deposition of the vapor of the energetic material on the layer of dry ice to continue for a few minutes to finish depositing on the dry ice the energetic material vapor remaining in the chamber.

Warming the vacuum chamber by stopping the circulation of the cold helium gas 92 through the set of thermally conductive pipes 100. Alternatively, by circulating helium gas warmer than −78.5° C. (sublimation temperature dry ice at atmospheric pressure) in the pipes, allowing the temperature inside the vacuum chamber to rise causing the dry ice layer to sublimate into carbon dioxide gas which increases the pressure inside the chamber.

Turning outlet valve 24 to the open outlet position 44*a* after the pressure inside the chamber builds up to about atmospheric pressure allowing the carbon dioxide gas resulting from further sublimation of the dry ice layer to escape.

As the layer of dry ice sublimes into carbon dioxide gas, the carbon dioxide gas also dislodges and breaks the layer of the amorphous energetic material from the set of thermally conductive pipes as a powder, which falls to the bottom of the vacuum chamber proximate to the powder collection port 28.

Collecting the powder from the vacuum chamber 8 by opening the powder collection port 28 enabling the powder to funnel out of the chamber as a dry and loose powder.

In the foregoing process the set of thermally conductive pipes have a majority of pipes that are vertically oriented, allowing more of the powder to have an unobstructed downward fall.

The process using cryogenic helium gas is suitable for scaling up to production levels the conversion of crystalline HMX to an amorphous powder of HMX, and can be equally used with other nitroamines.

For the dry ice layer, sufficient thickness is between 500 microns and 3 millimeter. For the amorphous energetic material layer, sufficient thickness is between 10 and 500 microns. The exact thickness of the dry ice layer depends on several technical aspects—for example, size of container, number of pipes in the chamber 8 in FIG. 2, thermal conductivity of the pipes material, thickness of the pipes walls as well as the desired amorphous powder particles size, which is mostly dictated by the thickness of the amorphous energetic material layer.

In general, the energetic material amorphous layer has to be 2 to 3 times thinner than the dry ice layer. If the dry ice layer is thick, the layer of the amorphous energetic material that will be deposited on it can be thin or thick. If the dry ice layer is thin, then the layer of the amorphous energetic material also will have to be thin.

Figure 3:
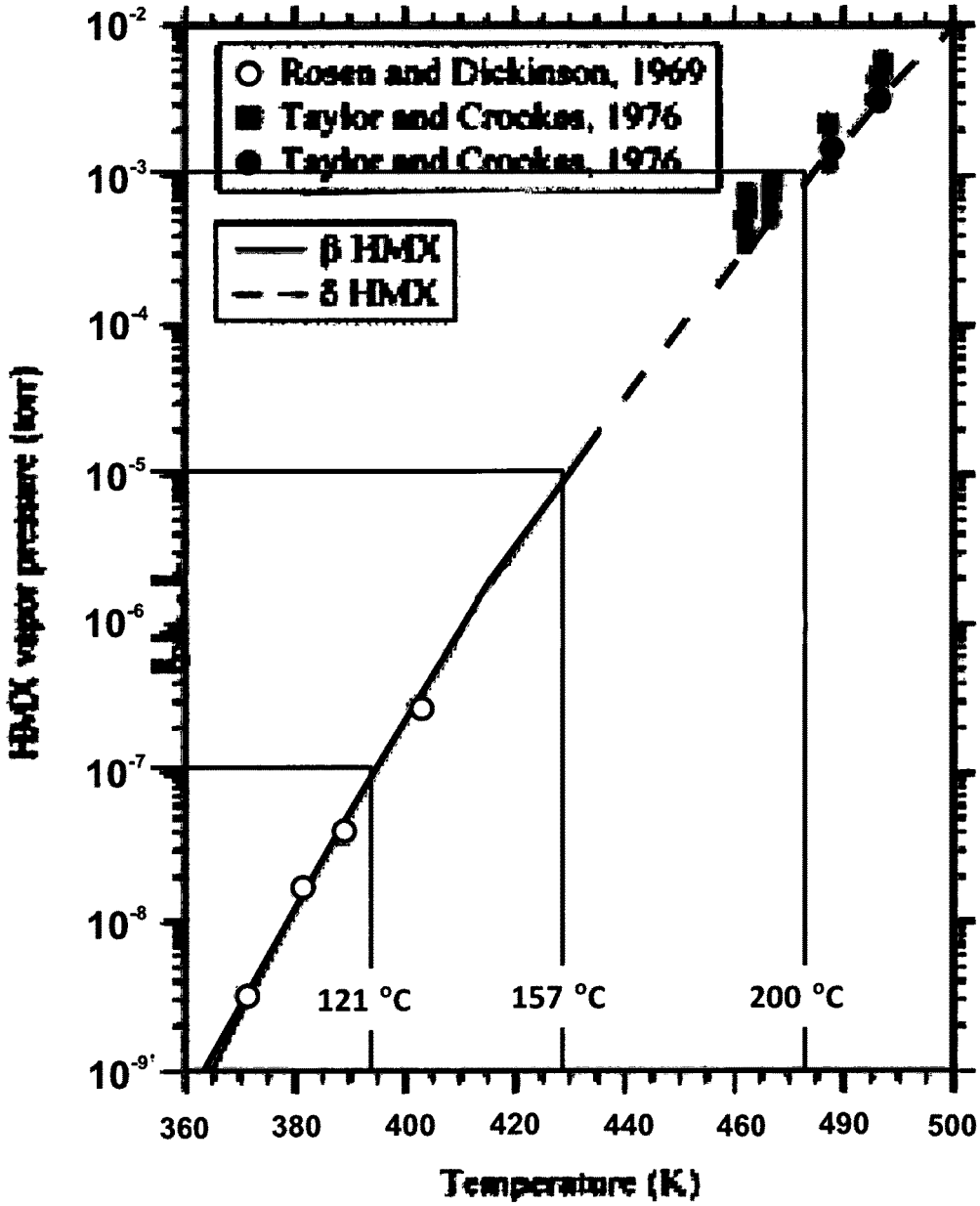
FIG. 3 is a graph of related, conventional art depicting the vapor pressure of the HMX over a range of temperatures.

As shown in FIG. 3 (Conventional, Related Art) the temperature at which the crystalline HMX starts to sublimate depends on the pressure. At 10 e-7 torr, crystalline HMX has to be heated to temperatures above 121° C. to sublimate the crystalline solid HMX into vapor, with higher temperatures needed at higher pressures. At 10 e-3 torr, crystalline HMX has to be heated to temperatures above 200° C. to sublimate it, which is still well below 275° C., the melting point of crystalline HMX, and even lower than the auto ignition temperature of HMX, 285° C., at which it starts decomposing and eventually ignites.

Figure 4:
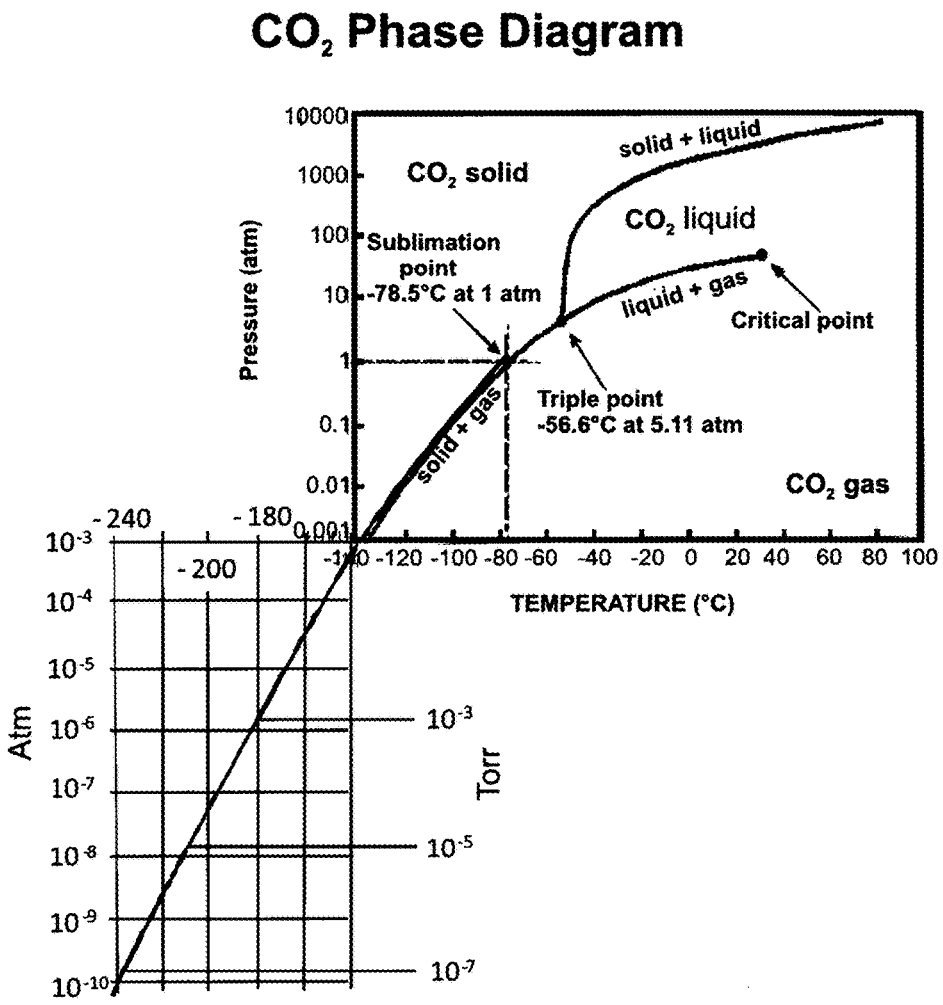
FIG. 4 is a phase diagram of related, conventional art for carbon dioxide, expanded to very low pressures reaching 10e-7 torr.

FIG. 4 is a (conventional, related art) phase diagram for carbon dioxide. As seen from the diagram, the triple point is at 5.11 atm, indicating that carbon dioxide can only exist in the liquid phase if the pressure is above 5.11 times the atmospheric pressure. At lower pressures, carbon dioxide sublimates when heated, i.e., turns from the solid phase, called dry ice, to the gas phase without melting first. For example, at normal atmospheric pressure (1 atm), dry ice sublimates at 194.5° K (−78.5° C.). The sublimation temperature decreases as the pressure is reduced. For example, at 10e-7 torr, dry ice sublimates at −235° C. The technical challenges to the process and the approach to resolving these challenges include: Safely producing the energetic material vapor. This is done by heating the solid energetic material, already synthesized in the crystalline phase, under high vacuum. Using HMX as an example of nitoramines, as illustrated in FIG. 3, the required temperature decreases when the pressure is reduced, allowing the vapor to be produced without getting close to HMX ignition temperature. For example, at $10^{-7}$ torr, we only have to heat HMX beyond 121° C.

A second challenge is how to extract, i.e., separate and collect the deposited amorphous solid from the surface it was deposited on, without resorting to scrubbing. This extraction is done by first forming a layer of dry ice on the cold substrate before, depositing the nitroamine vapor. After the vapor deposition process is completed, the substrate is allowed to warm up, whereby the dry ice sublimates into carbon dioxide gas, thus separating the deposited solid layer and breaking it into a powder.

At atmospheric pressure, the process of extracting the energetic material deposited on the substrate is self-evident, because at atmospheric pressure and room temperature, the amorphous energetic material is a solid, whereas dry ice is already a gas. As illustrated in FIG. 4, at atmospheric pressure, above 194.5° K (−78.5° C.) dry ice sublimates into carbon dioxide gas. However, in a vacuum chamber, the dry ice already formed on the cold walls at atmospheric pressure and low temperatures can spontaneously sublimate when the pressure is reduced below the vapor pressure of carbon dioxide at that temperature. The optimum chamber pressure is therefore a compromise between the lower pressures desired to reduce to safer levels the temperature to which the crystalline energetic material loaded in the piccolo tube has to be heated without auto igniting it, and the higher pressures desired to raise the temperature of the cold surfaces on which the dry ice forms to practical cryogenically achievable temperatures, so that, for example, submerging the vessel in liquid nitrogen, as shown in FIG. 1, is sufficient.

Table 1 in FIG. 6 lists for three different low chamber pressures, the minimum temperature derived from FIG. 3 to which the crystalline energetic material has to be heated in order to sublimate it, and based on FIG. 4, the maximum temperature of the cold surfaces on which the dry ice is formed to prevent its sublimation at low pressures. For example, for the tube-like vacuum chamber in FIG. 1, at a vacuum chamber pressure of $10^{-3}$ torr, HMX has to be heated to temperatures at or above 200° C., and the chamber walls have to be kept at temperatures below −180° C., so submerging the chamber in liquid nitrogen, at −196° C. or 77 K is sufficient. At $10^{-7}$ torr, the walls have to be maintained at temperatures below −235° C. (38° K), so submerging the vessel in FIG. 1 in liquid nitrogen is not sufficiently cold enough. Lower temperatures may be achieved by submerging or by circulating around the chamber a liquid or gas that is colder than −235° C.

Since helium remains in the gas phase at temperatures as low as 4 K, FIG. 4 indicates that even at chamber pressures as low as $10^{-7}$ torr, cooling the substrate to low enough temperatures to keep the carbon dioxide in the dry ice solid phase is achievable. Cooling the helium to temperatures as low as −235° C. (38 K) or lower, the maximum allowed temperature of the cold substrate at $10^{-7}$ torr, is practical using a 2-step process in which high pressure helium gas is first cooled in a heat exchanger using liquid nitrogen, and then cooled further to much colder temperatures by expanding the high pressure cold helium gas to atmospheric pressure into a nozzle.

The third challenge is how to avoid depositing the vapor on unwanted surfaces. The apparatus depicted in FIG. 1 resolves this challenge by having two and only two types of surfaces, neither of them unwanted. The piccolo tube on the axis and ceramic holder are hot, at or above the temperature needed to produce the nitroamine vapor of sublimation. The inward side of the enclosing wall 20 of the vacuum chamber 10 is cold, by virtue of being submerged in liquid nitrogen.

For the vacuum chamber in FIG. 2, the piccolo tube is hot and the pipes are cold, but the inner walls of the vacuum chamber shell 20 are approximately at room temperature, so the energetic material vapor will be deposited and a solid explosive layer will accumulate on them unless extra features are added to the design. The chamber walls may be made as hot as the piccolo tube or as cold as the pipes by surrounding the chamber with a jacket through which hot or cold helium may be circulated, respectively. For example, it is anticipated that the chamber 8 shown in FIG. 2, which is fitted with a set of thermally conductive pipes inside the chamber, could alternatively be a double walled chamber, wherein cryogenically cold gas is circulated through at least one cavity formed by the double walls.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A process for converting a crystalline energetic material to an amorphous energetic material, which is less susceptible to accidental detonation initiation by mechanical insults, comprising:

condensing carbon dioxide gas on a cryogenically cold surface in a vacuum chamber, therein forming a dry ice layer;

depositing, on the dry ice layer, vapors of sublimation produced by heating the crystalline energetic material under a vacuum inside the vacuum chamber, wherein the vapors of sublimation solidify forming a layer of the amorphous energetic material on the dry ice layer;

sublimating the dry ice layer by warming up the cold substrate on which it was formed, and breaking apart the layer of the amorphous energetic material into a powder; and collecting the powder of the amorphous energetic material.

2. The process according to claim 1, wherein the energetic material is broadly a class of materials comprised of nitroamines.

3. The process according to claim 2, wherein the nitroamines are selected from the group consisting of HMX (Octahydro-1,3,5,7-tetranitro-1,3,5,7-tetrazocine), RDX (1,3,5-Trinitro-perhydro-1,3,5-triazine), Nitroguanidine (1-Nitroguanidine), and CL-20 (Hexanitrohexaazaisowurtzitane).

4. The process according to claim 1, wherein the amorphous energetic material, which is formed, is as energetically potent as the crystalline energetic material.

5. The process according to claim 1, wherein the amorphous energetic material is softened when heated above its glass transition temperature but below its melting point, and wherein as a softened amorphous energetic material it is moldable into a form.

6. The process according to claim 5, wherein the form is a consolidated explosive charge comprised solely of the amorphous energetic material.

7. The process according to claim 5, wherein the form comprises a binder.

8. The process according to claim 1, wherein the dry ice layer is built up by circulating the carbon dioxide gas past a cryogenically cold surface in a vacuum chamber.

9. The process according to claim 1, wherein said breaking the layer of the amorphous energetic material into the powder is augmented by an intercalation of dry ice during said forming the layer of the amorphous energetic material on the dry ice layer.

10. A process for converting a crystalline energetic material to an amorphous energetic material, comprising:

providing a vacuum chamber with an access port, wherein the vacuum chamber includes an enclosing wall that is thermally conductive and mechanically sufficient to withstand evacuation to a pressure as low as about 10e-3 torr and cryogenic cooling to a temperature at least as low as about −196° C., wherein the vacuum chamber includes an inlet with a two-way valve through which carbon dioxide gas flows into the vacuum chamber, an outlet with a three-way valve, wherein in an open outlet position gas flows in or out of the vacuum chamber, in a closed outlet position flow is occluded, and in a vacuum position gas is evacuated from the vacuum chamber, a holder with a piccolo tube with a plurality of perforations and a heating element, and wherein said holder is mounted on a sealing plug for the access port;

loading the piccolo tube with the crystalline energetic material and positioning the holder and the piccolo tube in the vacuum chamber;

closing the access port with the sealing plug;

purging any air initially inside the vacuum chamber while the vacuum chamber is at a pressure of about one atmosphere by circulating the carbon dioxide gas for several minutes through the vacuum chamber;

submerging the vacuum chamber in a bath of liquid nitrogen condensing the circulating carbon dioxide gas forming a layer of dry ice on an inward side of the enclosing wall;

continuing circulating the carbon dioxide gas until a dry ice layer sufficiently thick is formed, wherein circulating the carbon dioxide gas is ceased;

evacuating the carbon dioxide gas remaining inside the vacuum chamber until the pressure in the vacuum chamber is reduced to about 10 e-3 torr, and closing the three-way valve;

using the heating element for heating the crystalline energetic material above its sublimation temperature corresponding to the pressure of about 10 e-3 torr, where the energetic material sublimates producing vapors of sublimation of the energetic material;

depositing the vapors of sublimation on the dry ice layer forming a second layer comprised of an amorphous energetic material;

adjusting the rate of heating, wherein a rate of generating the vapors of sublimation is about equal to the rate of depositing the vapors of sublimation on the dry ice layer, therein maintaining the pressure inside the vacuum chamber at about 10 e-3 torr;

turning off the heating element after a layer of the amorphous energetic material sufficiently thick is formed on the dry ice layer;

allowing the deposition of the vapors of sublimation on the dry ice layer to continue for several more minutes, therein providing time for formed vapors of sublimation to be deposited;

warming the vacuum chamber by removing it from the bath of liquid nitrogen allowing the temperature inside the vacuum chamber to rise causing the dry ice layer to sublimate into carbon dioxide gas, therein increasing the pressure inside the chamber;

continuing the sublimation of the dry ice layer producing more carbon dioxide gases which dislodge and breakup the layer of the amorphous energetic material, separating the amorphous energetic material as powder from the inward side of the enclosing wall;

opening the outlet three-way valve after the pressure inside the chamber builds up to about one atmosphere enabling the carbon dioxide gas resulting from further sublimation of the dry ice layer to escape from the vacuum chamber; and collecting the amorphous energetic powder from the vacuum chamber.

11. The process according to claim 10, wherein said collecting the amorphous energetic powder is performed by removing the sealing plug from the access port and pouring out the powder through the access port.

12. The process according to claim 10, wherein the energetic material is broadly a class of materials comprised of nitroamines.

13. The process according to claim 12, wherein the nitroamines are selected from the group consisting of HMX (Octahydro-1,3,5,7-tetranitro-1,3,5,7-tetrazocine), RDX (1,3,5-Trinitro-perhydro-1,3,5-triazine), Nitroguanidine (1-Nitroguanidine), and CL-20 (Hexanitrohexaazaisowurtzitane).

14. The process according to claim 10, wherein the amorphous energetic material is softened when heated above its glass transition temperature but well below its melting point, and wherein as a softened amorphous energetic material it is moldable into a form.

15. The process according to claim 10, wherein the enclosing wall is comprised of at least one metal, which is thermally conductive, and wherein said at least one metal is selected from copper having a thermal conductivity of 0.92 calorie/sec*centimeter*° C., aluminum having a thermal conductivity of 0.49 calorie/sec*centimeter*° C., and brass having a thermal conductivity of 0.26 calorie/sec*centimeter*° C.

16. The process according to claim 12, wherein the nitroamines is comprised of crystalline HMX (Octahydro-1,3,5,7-tetranitro-1,3,5,7-tetrazocine), and wherein when converting the crystalline HMX to amorphous HMX the heater is nominally heated to about 210° C.±about 10° C.

17. A process for converting a crystalline energetic material to an amorphous energetic material, comprising:

providing a chamber, with an access port and a powder collection port, wherein the chamber includes an enclosing wall mechanically sufficient to withstand evacuation to a pressure as low as about 10e-7 torr and mechanically sufficient to support a set of thermally conductive pipes through which cold helium gas can circulate to provide a cryogenically cold surface, wherein the cold helium gas has a temperature of about −235° C. or lower, wherein the vacuum chamber has an inlet with a two way valve, an outlet with a three-way valve, wherein in an open outlet position gas flows in or out of the vacuum chamber, in a closed outlet position flow is occluded, and in a vacuum position gas is evacuated from the vacuum chamber, and a holder mounted on a sealing plug for the access port, wherein said holder includes a heating element and a piccolo tube with a plurality of perforations, providing a controlled flow of carbon dioxide into the vacuum chamber through the inlet when the two-way valve is open, and no flow through the inlet when the two-way valve is closed;

loading the piccolo tube on the holder with the crystalline energetic material and positioning the loaded piccolo tube in the vacuum chamber and sealing the access port;

purging any air initially inside the vacuum chamber while the vacuum chamber is at a pressure that is about one atmosphere by circulating the carbon dioxide gas for several minutes through the vacuum chamber;

starting the circulation of cold helium gas through the set of thermally conductive pipes;

continuing circulating the carbon dioxide gas until a dry ice layer that is sufficiently thick is formed on the set of thermally conductive pipes, wherein circulating the carbon dioxide gas is ceased;

evacuating the carbon dioxide gas remaining inside the chamber, until the pressure is reduced to about 10 e-7 torr, and closing the three-way valve;

using the heating elements for heating the crystalline energetic material to a temperature above its sublimation temperature corresponding to the pressure of about 10 e-7 torr, where the energetic material sublimates producing vapors of sublimation of the energetic material;

depositing the vapors of sublimation on the dry ice layer forming a second layer comprised of an amorphous energetic material;

adjusting the rate of heating, wherein a rate of generating the vapors of sublimation is about equal to the rate of depositing the vapors of sublimation on the dry ice layer, therein maintaining the pressure inside the vacuum chamber at about 10 e-7 torr;

turning off the heating element after a layer of the amorphous energetic material sufficiently thick is formed on the dry ice layer;

allowing the deposition of the vapors of sublimation on the dry ice layer to continue for a few minutes, therein providing time for formed vapors of sublimation to be deposited;

warming the chamber by stopping the circulation of the cold helium gas through the set of thermally conductive pipes (or, alternatively, by circulating helium gas warmer than −78.5° C. in the pipes), allowing the temperature inside the chamber to rise causing the dry ice layer to sublimate into carbon dioxide gas which increases the pressure inside the chamber;

opening the outlet three-way valve after the pressure inside the chamber builds up to about one atmosphere enabling the carbon dioxide gas resulting from further sublimation of the dry ice layer to escape from the vacuum chamber;

subliming the dry ice layer producing carbon dioxide gas, wherein the carbon dioxide gas dislodges and breaks the layer of the amorphous energetic material from the set of thermally conductive pipes as a powder, which falls to a bottom of the vacuum chamber; and collecting the powder from the chamber through the powder collection port, wherein the powder funnels out of the chamber as a relatively warm, dry and loose material.

18. The process according to claim 17, wherein the energetic material is broadly a class of materials comprised of nitroamines.

19. The process according to claim 17, wherein the crystalline energetic material is HMX (Octahydro-1,3,5,7-tetranitro-1,3,5,7-tetrazocine).

20. The process according to claim 19, wherein the heater heats the crystalline HMX to about 131° C. ± about 10° C.

21. The process according to claim 17, wherein the set of thermally conductive pipes includes a majority of pipes that are vertically oriented to allow more of the powder to have an unobstructed downward fall.

* * * * *